US009063496B2

(12) United States Patent
Sakato et al.

(10) Patent No.: US 9,063,496 B2
(45) Date of Patent: Jun. 23, 2015

(54) IMAGE FORMING APPARATUS INCLUDING A CONTROL UNIT CONTROLLING BIAS APPLIED TO A CHARGING MEMBER AND A TRANSFER MEMBER

(71) Applicant: KYOCERA Document Solutions Inc., Osaka-shi (JP)

(72) Inventors: Shingo Sakato, Osaka (JP); Takuji Watanabe, Osaka (JP)

(73) Assignee: KYOCERA DOCUMENT SOLUTIONS INC., Osaka-Shi (JP)

( * ) Notice: Subject to any disclaimer, the term of this patent is extended or adjusted under 35 U.S.C. 154(b) by 87 days.

(21) Appl. No.: 13/867,459

(22) Filed: Apr. 22, 2013

(65) Prior Publication Data

US 2013/0279928 A1 Oct. 24, 2013

(30) Foreign Application Priority Data

Apr. 24, 2012 (JP) ..... 2012-098932

(51) Int. Cl.

| | |
|---|---|
| ***G03G 15/02*** | (2006.01) |
| ***G03G 15/24*** | (2006.01) |
| ***G03G 15/16*** | (2006.01) |

(52) U.S. Cl.

CPC ..... *G03G 15/24* (2013.01); *G03G 15/0266* (2013.01); *G03G 15/1675* (2013.01)

(58) Field of Classification Search

CPC G03G 15/24; G03G 15/0266; G03G 15/1675
USPC ..... 399/38, 46, 50, 66
See application file for complete search history.

(56) References Cited

U.S. PATENT DOCUMENTS 8,050,581 B2 * 11/2011 Chang et al. ..... 399/50

FOREIGN PATENT DOCUMENTS

| | | | |
|---|---|---|---|
| JP | 10-048914 | A | 2/1998 |
| JP | 10-228158 | A | 8/1998 |
| JP | 2003-091146 | A | 3/2003 |
| JP | 2004-205583 | A | 7/2004 |

OTHER PUBLICATIONS

Notice of Reasons for Rejection issued to JP Application No. 2012-098932, mailed Jun. 17, 2014.

* cited by examiner

*Primary Examiner* — William J Royer
(74) *Attorney, Agent, or Firm* — Knobbe Martens Olson & Bear LLP

(57) ABSTRACT

An image forming apparatus includes a photosensitive drum, a charging roller, a transfer roller, a first bias application unit, a second bias application unit, and a control unit. The charging roller contains an ion conductive material. The first bias application unit applies a first bias to the charging roller. The second bias application unit applies a predetermined bias to the transfer roller. The control unit controls the first bias application unit not to apply the first bias to the charging roller in a non-image forming period in which a toner image is not formed on the photosensitive drum. The control unit controls the second bias application unit to apply the second bias, which is a bias that can electrically charge the surface of the photosensitive drum, to the transfer roller in the non-image forming period.

3 Claims, 6 Drawing Sheets

IMAGE FORMING APPARATUS INCLUDING A CONTROL UNIT CONTROLLING BIAS APPLIED TO A CHARGING MEMBER AND A TRANSFER MEMBER

INCORPORATION BY REFERENCE

This application is based upon and claims the benefit of priority from the corresponding Japanese Patent Application No. 2012-098932, filed in the Japan Patent Office on Apr. 24, 2012, the entire contents of which are incorporated herein by reference.

BACKGROUND

The present disclosure relates to an image forming apparatus that can form an image on a transfer object using a toner.

As an image forming apparatus, a printer, a copy machine, a multifunction peripheral and the like can be exemplified. A type of image forming apparatus has been known that forms an image on a sheet of paper by first forming a toner image on a surface of a photosensitive drum and then transferring the toner image to a sheet of paper (transfer object). Such an image forming apparatus is provided with a charging roller (charging member) that electrically charges the surface of the photosensitive drum. The charging roller must be electrically conductive and therefore includes an ion conductive material.

In a case in which the image forming apparatus forms images on many sheets of paper, polarization of the ion conductive material arises inside the charging roller. This increases resistance of the charging roller and makes it difficult to prolong the operating life of the charging roller.

Given this, a charging device has been proposed that alleviates polarization of the ion conductive material by applying to the charging roller a reversed polarity bias to that charged on the photosensitive drum when no image is formed on the paper.

However, in the above described charging device, a power source is newly required for applying the reversed polarity bias the to the charging roller. In addition, in the above described charging device, a power source is newly required for applying the reversed polarity bias to the charging roller. Therefore, the conventional image forming apparatus requires a member or the like for alleviating polarization of the ion conductive material included in the charging member (charging roller), which increases the cost and makes the configuration of the image forming apparatus more complex.

SUMMARY

The present disclosure relates to an image forming apparatus that includes an image carrier, a charging member, a developing unit, a transfer member, a first bias application unit, a second bias application unit, and a control unit. The charging member contains an ion conductive material and is arranged in contact with or in proximity to the image carrier to electrically charge a surface of the image carrier. The developing unit forms a toner image on the surface of the image carrier. The transfer member transfers the toner image formed on the surface of the image carrier to a transfer object. The first bias application unit applies a first bias to the charging member. The second bias application unit applies a predetermined bias to the transfer member. The control unit controls the first bias application unit and the second bias application unit. The control unit controls the first bias application unit not to apply the first bias to the charging member in a non-image forming period in which a toner image is not formed on the image carrier. The control unit controls the second bias application unit to apply to the transfer member a second bias, which is a bias that can electrically charge the surface of the image carrier, in the non-image forming period.

DETAILED DESCRIPTION

Embodiments of the present disclosure are described hereinafter with reference to the drawings.

Figure 1:
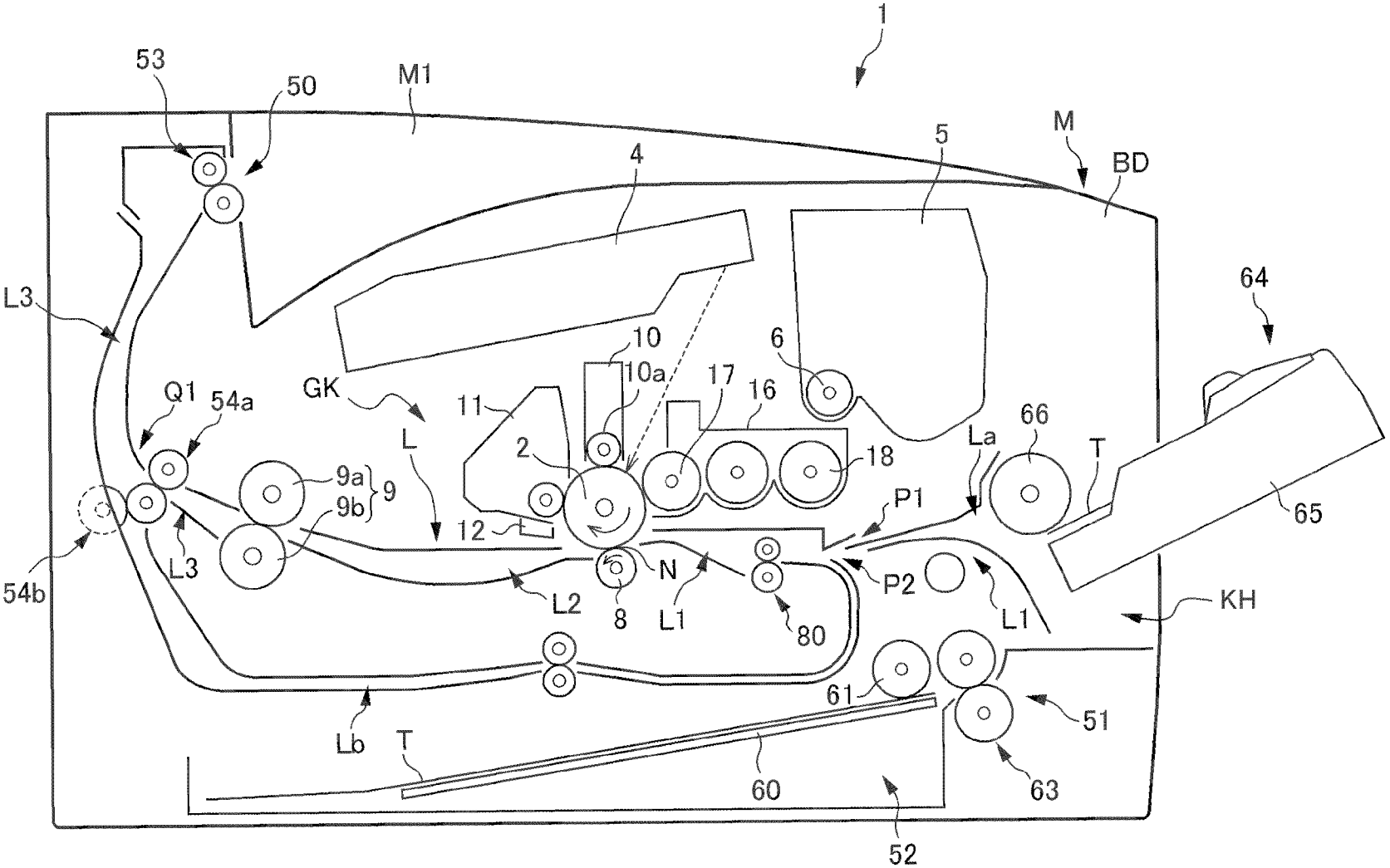
FIG. 1 is a diagram illustrating arrangement of components of a printer according to an embodiment of the present disclosure.

The overall structure of a printer 1 will be described as an image forming apparatus according to the present embodiment, with reference to FIG. 1. FIG. 1 is a diagram illustrating arrangement of components of the printer 1 according to the embodiment.

As shown in FIG. 1, the printer 1 as the image forming apparatus includes: an apparatus main body M; an image forming unit GK that forms a predetermined toner image on paper T as a sheet-shaped image transfer object based on predetermined image information; and a paper feeding/discharging part KH that feeds the paper T to the image forming unit GK and discharges the paper T on which the toner image is formed.

An external shape of the apparatus main body M is composed of a casing body BD as a housing.

As shown in FIG. 1, the image forming unit GK includes a photosensitive drum 2 as an image carrier (photosensitive body), a charging unit 10, a laser scanner unit 4 as an exposure unit, a developing unit 16, a toner cartridge 5, a toner supply unit 6, a drum-cleaning unit 11, a neutralization unit 12, a transfer roller 8, and a fuser 9.

As shown in FIG. 1, the paper feeding/discharging part KH includes a paper feeding cassette 52, a manual feeding portion 64, a paper path L for the paper T, a pair of registration rollers 80, and a paper discharging unit 50.

Components of the image forming unit GK and the paper feeding/discharging part KH are described in detail hereinafter.

First, a description is provided for the image forming unit GK.

Charging by the charging unit 10, exposure by the laser scanner unit 4, development by the developing unit 16, transfer by the transfer roller 8, neutralization by the neutralization unit 12, and cleaning by the drum cleaning unit 11 are sequentially performed in order, from an upstream side to a downstream side along a surface of the photosensitive drum 2 in the image forming unit GK.

The photosensitive drum 2 consists of a cylindrical member, and functions as a photosensitive body or an image carrier. The photosensitive drum 2 is disposed to be rotatable in a direction indicated by an arrow about a rotational shaft extending in a direction orthogonal to a direction in which the paper T is conveyed through the paper path L. An electrostatic latent image may be formed on the surface of the photosensitive drum 2.

The charging unit 10 is arranged opposite to the surface of the photosensitive drum 2. Details of the charging unit 10 are described later.

The laser scanner unit 4 functions as an exposure unit, and is disposed to be spaced apart from the surface of the photosensitive drum 2. The laser scanner unit 4 is configured with a laser light source, a polygonal mirror, a polygonal-mirror-driving motor and the like, none of which are illustrated in the drawings.

The laser scanner unit 4 scans and exposes the surface of the photosensitive drum 2 based on image information that is input from an external device such as a PC (personal computer). By being scanned and exposed by the laser scanner unit 4, an electric charge in the exposed portion on the surface of the photosensitive drum 2 is removed. In this way, an electrostatic latent image is formed on a surface of the photosensitive drum 2.

The developing unit 16 (developing portion) is provided in correspondence with the photosensitive drum 2, and is arranged opposite to the surface of the photosensitive drum 2. The developing unit 16 causes single color toner (usually black toner) to adhere to an electrostatic latent image formed on the photosensitive drum 2, thereby forming a single color toner image on the surface of the photosensitive drum 2. The developing unit 16 is configured with a developing roller 17 arranged opposite to the surface of the photosensitive drum 2, an agitation roller 18 for agitating toner, and the like.

The toner cartridge 5 is provided in correspondence with the developing unit 16, and stores toner to be supplied to the developing unit 16.

The toner supply unit 6 is provided in correspondence with the toner cartridge 5 and the developing unit 16, and supplies toner stored in the toner cartridge 5 to the developing unit 16. The toner supply unit 6 and the developing unit 16 are connected with each other via a toner feed passage that is not illustrated in the drawings.

The transfer roller 8 (transfer member) transfers a toner image, which has been developed on the surface of the photosensitive drum 2, onto the paper T. A transfer bias application unit (not shown) applies a transfer bias to the transfer roller 8 for transferring a toner image formed on the photosensitive drum 2 onto the paper T. The transfer roller 8 is configured to be rotatable in contact with the photosensitive drum 2.

The paper T conveyed through the paper path L is interposed between the photosensitive drum 2 and the transfer roller 8. The interposed paper T is pressed against the surface of the photosensitive drum 2. A transfer nip N is formed between the photosensitive drum 2 and the transfer roller 8. In the transfer nip N, a toner image developed on the photosensitive drum 2 is transferred onto the paper T.

The neutralization unit 12 is arranged opposite to the surface of the photosensitive drum 2. By radiating light on the surface of the photosensitive drum 2, the neutralization unit 12 removes static electricity (neutralizes electrical charge) on the surface of the photosensitive drum 2, onto which the transfer has been performed.

The drum-cleaning unit 11 is arranged opposite to the surface of the photosensitive drum 2. The drum-cleaning unit 11 removes toner and attached matter remaining on the surface of the photosensitive drum 2, and conveys the toner and the like thus removed to a predetermined collecting mechanism for collection thereof.

By melting and pressurizing the toner that forms a toner image transferred onto the paper T, the fusing unit 9 fixes the toner on the paper T. The fusing unit 9 includes a heating rotator 9*a* that is heated by a heater, and a pressurizing rotator 9*b* that is brought into pressure-contact with the heat rotator 9*a*. The heating rotor 9*a* and the pressing rotor 9*b* interpose, press and convey the paper T with the toner image transferred thereon. The paper T is conveyed in a state of being sandwiched between the heating rotator 9*a* and the pressurizing rotator 9*b*, whereby the toner transferred to the paper T is fused and compressed and fixed to the paper T.

Next, the paper feeding/discharging part KH is described.

As shown in FIG. 1, one paper feeding cassette 52 for storing paper T is disposed in a lower portion of the apparatus main body M. The paper feeding cassette 52 is configured to be capable of being horizontally withdrawn from a right side (right side in FIG. 1) of the apparatus main body M. The paper feeding cassette 52 includes a paper tray 60 on which the sheets of paper T are placed. The paper feeding cassette 52 stores the sheets of paper T stacked on the sheet of paper Tray 60. A sheet of paper T placed on the sheet of paper tray 60 is fed to the paper feed path L by a cassette feeding unit 51 disposed in an end part of the paper feeding cassette 52 on a side of feeding the sheet of paper (at a right end portion of FIG. 1). The cassette feeding unit 51 includes a double feed prevention mechanism consisting of: a forward feed roller 61 for picking up the paper T on the paper tray 60; and a pair of paper feeding rollers 63 for feeding the sheet of paper T one by one to the paper path L.

A manual paper feed unit 64 is provided on the right side (right side in FIG. 1) in the apparatus main body M. The manual feeding portion 64 is provided primarily for the purpose of feeding paper T that is different in size and type from the paper T stored in the paper feeding cassette 52 to the apparatus main body M. The manual paper feed unit 64 includes a manual feeding tray 65 and a paper feeding roller 66 configuring a part of the front face of the apparatus main body M in a closed state. A lower end of the manual feeding tray 65 is rotatably attached to the apparatus main body M in the vicinity of the paper feeding roller 66 (openable and closable). A sheet of paper T is placed on the manual feeding tray 65 while it is open. The paper feeding roller 66 feeds a sheet of paper T placed on the manual feeding tray 65 while it is open to the manual feeding path La.

A paper discharging unit 50 is provided to an upper side of the apparatus main body M. The paper discharging unit 50 discharges the paper T to the outside of the device main body M by way of a third pair of rollers 53. Details of the paper discharging unit 50 are described later.

The paper path L which conveys paper T includes: a first paper path L1 from the cassette feeding unit 51 to the transfer nip N; a second paper path L2 from the transfer nip N to the fusing unit 9; a third paper path L3 from the fusing unit 9 to the paper discharging unit 50; the manual feeding path La that guides paper fed from the manual feeding unit 64 to the first paper path L1; and a reverse paper path Lb that reverses and returns the paper that is fed from a downstream side to an upstream side in the third paper feed path L3 to the first paper path L1.

In addition, a first junction P1 and a second junction P2 are provided in the route of the first paper path L1. A first branch portion Q1 is provided in the route of the third paper path L3.

The first junction P1 is a junction where the manual feeding path La joins the first paper feed path L1. The second junction P2 is a junction where the reverse paper path Lb joins the first paper path L1. In the first branch portion Q1, the reverse paper path Lb branches off the third paper path L3.

The first branch portion Q1 has a first pair of rollers 54*a* and a second pair of rollers 54*b*. The same roller concurrently serves as one of the first pair of rollers 54*a* and one of the second pair of rollers 54*b*.

In addition, a sensor for detecting the paper T and a pair of registration rollers 80 for skew (oblique feeding) compensation of the paper T and timing adjustment between formation of the toner image in the image forming unit GK and feed of the paper T, are disposed in the route of the first paper path L1 (more specifically, between the second junction P2 and the transfer roller 8). The sensor is disposed immediately before the pair of registration rollers 80 in the conveyance direction of the paper T (on the upstream side in the conveyance direction). The pair of registration rollers 80 conveys the paper T by performing the aforementioned compensation and timing adjustment based on detection signal information from the sensor.

The reverse paper path Lb is a paper path provided for the purpose of making a surface (unprinted surface), which is opposite to a surface that has already been printed, face the photosensitive drum 2 when performing duplex printing on the paper T.

By using the reverse paper path Lb, the paper T conveyed from the first branch portion Q1 to the paper discharging unit 50 side by way of the first pair of rollers 54*a* can be reversed and then returned to the first paper path L1 by way of the second pair of rollers 54*b*, and the paper T can be conveyed to the upstream side of the pair of registration rollers 80 disposed on the upstream side of the transfer roller 8. At the transfer nip N2, a predetermined toner image is transferred to the unprinted surface of the sheet of paper T that has been reversed by the reverse paper path Lb.

The paper discharging unit 50 is formed in an end portion of the third paper path L3. The paper discharging unit 50 is disposed in an upper portion of the apparatus main body M. The paper discharging unit 50 is open toward the right side (right side in FIG. 1, and the manual paper feed unit 64 side) of the apparatus main body M. The paper discharging unit 50 discharges the paper T conveyed from the third paper path L3 to the outside of the apparatus main body M by way of the third pair of rollers 53.

A discharged paper collection part M1 is formed in the vicinity of the opening of the paper discharging unit 50. The discharged paper collection part M1 is formed on an upper face (outer face) of the apparatus main body M. The discharged paper collection part M1 is a portion of the upper face of the apparatus main body M formed to be depressed downward. The bottom face of the discharged paper collection part M1 constitutes a part of the upper face of the apparatus main body M. The paper T, on which a predetermined toner image is formed and which is discharged from the paper discharging unit 50, is stacked and collected in the discharged paper collection part M1.

It should be noted that a sensor for detecting paper is disposed in a predetermined position on each paper path.

Next, the charging unit 10 is described hereinafter. The charging unit 10 uniformly charges the surface of the photosensitive drum 2. More specifically, the charging unit 10 includes a charging roller 10*a* (charging member). The charging roller 10*a* is arranged in contact with or in proximity to the photosensitive drum 2. In a case in which the charging roller 10*a* is arranged in proximity to the photosensitive drum 2, a distance between the charging roller 10*a* and the photosensitive drum 2 is approximately 50 to 100 um.

In addition, the charging roller 10*a* includes an ion conductive material for electrically charging the surface of the photosensitive drum 2. As a specific example, the charging roller 10*a* includes a cylindrical ion conductive material (not illustrated) provided with a metallic shaft (not illustrated) as a central shaft. The ion conductive material is, for example, conductive rubber such as epichlorohydrin rubber.

Figure 2:
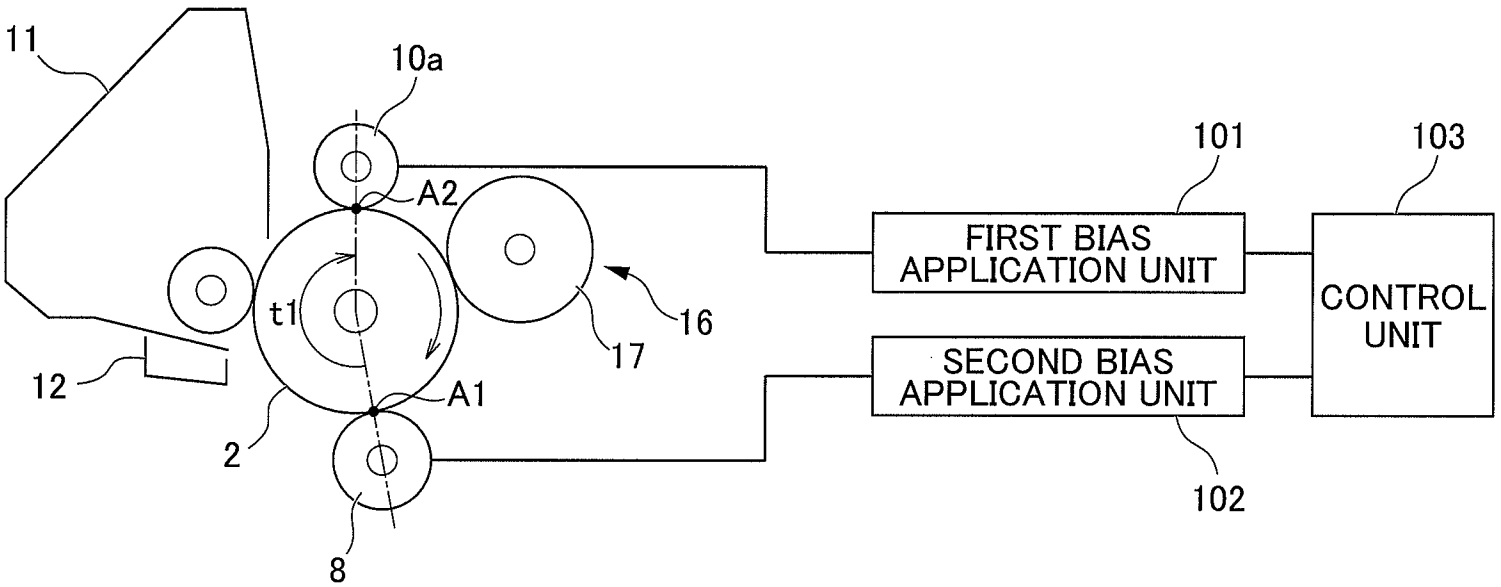
FIG. 2 is a diagram illustrating a photosensitive drum, a charging roller, a transfer roller, a first bias application unit, a second bias application unit, and the control unit.
Figure 3:
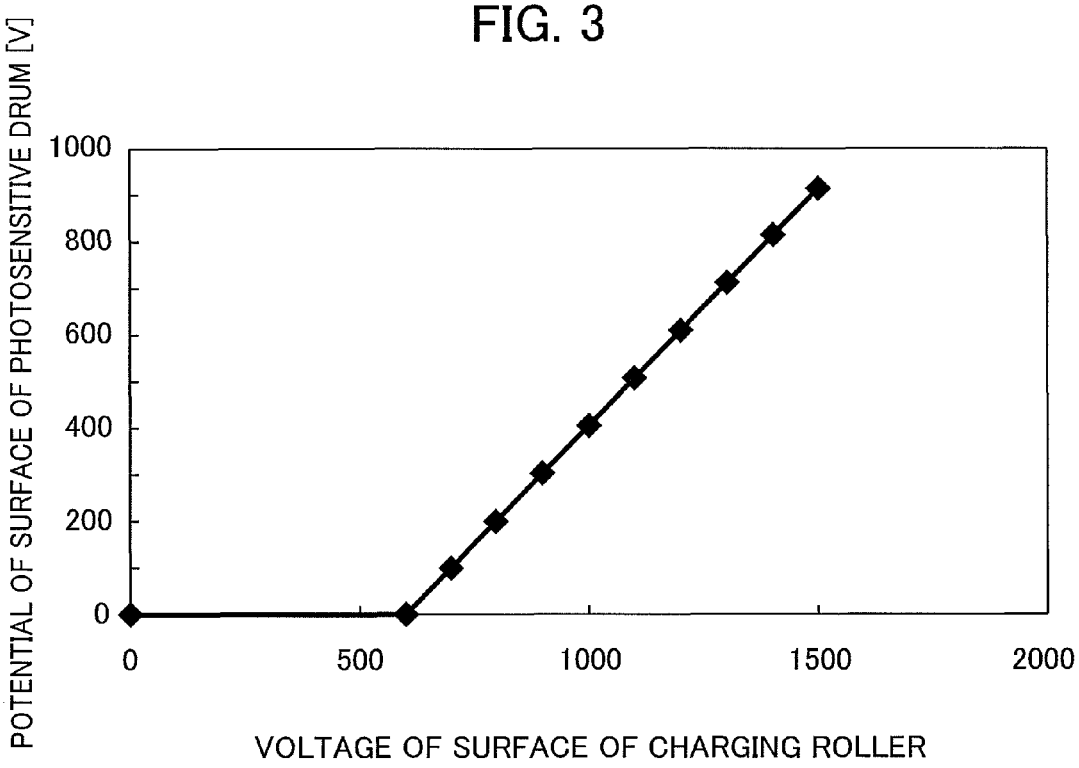
FIG. 3 is a diagram showing an example of a relationship between the potential of the surface of the photosensitive drum and a voltage of the surface of the charging roller.
Figure 4:
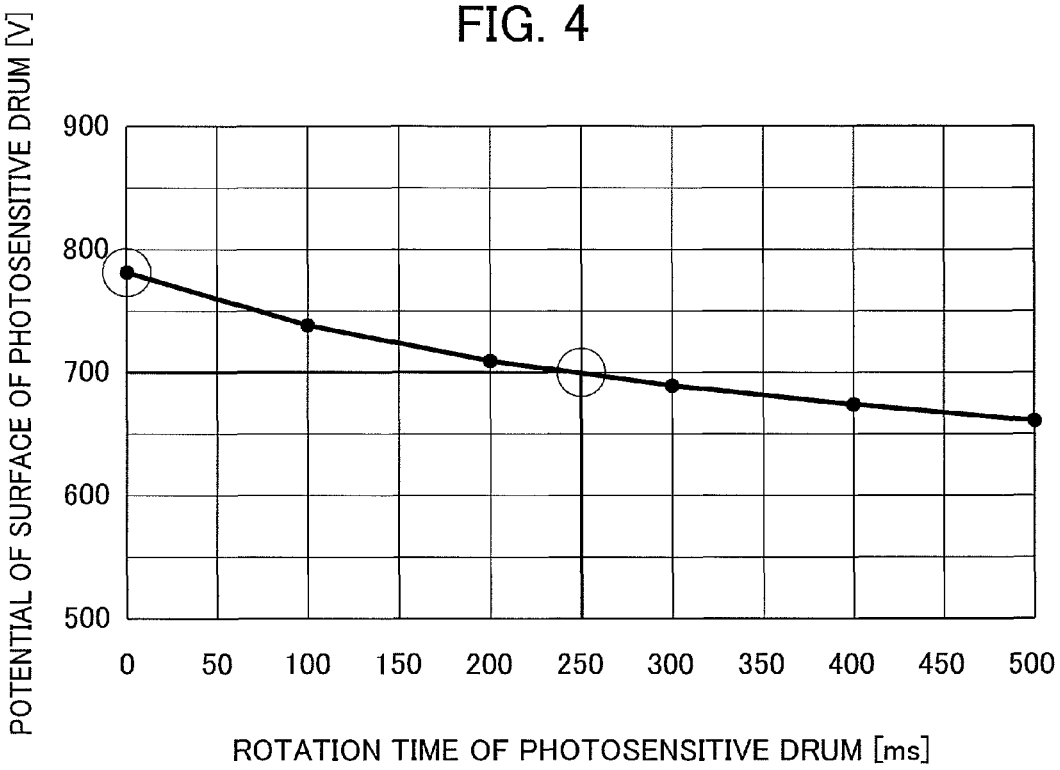
FIG. 4 is a diagram showing an example of a relationship between the potential of the surface of the photosensitive drum and rotation time of the photosensitive drum.

FIG. 2 is a diagram illustrating the photosensitive drum 2, the charging roller 10*a*, the transfer roller 8, the first bias application unit 101, the second bias application unit 102, and the control unit 103. FIG. 3 is a diagram showing an example of a relationship between the potential of the surface of the photosensitive drum 2 and a voltage of the surface of the charging roller 10*a*. FIG. 4 is a diagram showing an example of a relationship between the potential of the surface of the photosensitive drum 2 and a rotation time of the photosensitive drum 2.

As shown in FIG. 2, the above described printer 1 further includes the first bias application unit 101, the second bias application unit 102, and the control unit 103.

The first bias application unit 101 applies a first bias to the charging roller 10*a*, under control of the control unit 103.

The second bias application unit 102 applies a predetermined bias to the transfer roller 8, under control of the control unit 103.

The control unit 103 controls the first bias application unit 101 and the second bias application unit 102. More specifically, the control unit 103 controls the first bias application unit 101 not to apply the first bias to the charging roller 10*a* in a non-image forming period. In addition, the control unit 103 controls the second bias application unit 102 to apply the second bias, which is a bias that can electrically charge the surface of the photosensitive drum 2, to the transfer roller 8 in the non-image forming period. The non-image forming period is a time period in which a toner image is not formed on the photosensitive drum 2 after completion of a job as an instruction for forming an image on the paper T. In other words, the non-image forming period is a time period in which post processing is performed after the completion of the job (approximately 10 seconds, for example).

Here, in a case in which the surface of the photosensitive drum 2 is electrically charged by the transfer roller 8 to which the second bias has been applied, a potential difference between the photosensitive drum 2 and the charging roller 10*a* is greater than a voltage at which electrical discharge starts between the photosensitive drum 2 and the charging roller 10*a*. In other words, in a case in which the surface of the photosensitive drum 2 is electrically charged by the transfer roller 8 to which the second bias has been applied, when the photosensitive drum 2 thus electrically charged by the transfer roller 8 moves to a contact part or a proximity part to the charging roller, a potential at a surface of the photosensitive drum 2 at the contact part or the proximity part of the photosensitive drum 2 and the charging roller 10*a* is greater than a voltage at which electrical discharge starts between the photosensitive drum 2 and the charging roller 10*a*. The contact part is a position at which the photosensitive drum 2 and the charging roller 10*a* contacts each other, and a peripheral position at a periphery of this contact position, in a case in which the photosensitive drum 2 and the charging roller 10*a* are arranged in contact with each other. The proximity part is a closest proximity position at which the photosensitive drum 2 and the charging roller 10*a* are closest to each other, and a proximity position at a periphery of this closest proximity position, in a case in which the photosensitive drum 2 and the charging roller 10*a* are arranged in proximity to each other.

Here, as obvious from FIG. 3, for example in a case in which the voltage of the surface of the charging roller 10*a* is greater than 600 V, the surface of the photosensitive drum 2 is electrically charged. In other words, in a case in which a potential difference between the surface of the photosensitive drum 2 and the surface of the charging roller 10*a* is greater than 600 V, electrical discharge occurs between the photosensitive drum 2 and the charging roller 10*a*.

On the other hand, in a case in which the second bias application unit 102 applies the second bias to the transfer roller 8, the surface of the photosensitive drum 2 is electrically charged. However, the potential of the surface of the photosensitive drum 2 decreases due to dark decay. For example, in a case in which: an external diameter of the photosensitive drum 2 is ϕ30 mm, processing speed is 200 mm/sec, and an angle between the contact position between the transfer roller 8 and the photosensitive drum 2 (first position A1) and the contact part (proximity part) between the charging roller 10*a* and the photosensitive drum 2 (second position A2) is 192.6°, an amount of time required for the photosensitive drum 2 to rotate from the first position A1 to the second position A2 is 252 msec.

In addition, in a case in which the second bias application unit 102 applies a voltage of +1300 V as the second bias to the transfer roller 8, the surface of the photosensitive drum 2 is electrically charged to +800 V at the first position A1. As obvious from FIG. 4, the surface of the photosensitive drum 2 electrically charged to +800 V at the first position A1 is electrically charged to +700 V upon reaching the second position A2 as a result of rotation thereof (when t1=252 msec has elapsed since the photosensitive drum 2 is positioned at the first position A1). Here, the potential of the surface of the photosensitive drum 2 (+700 V) at the second position A2 is greater than the voltage at which electrical discharge starts between the photosensitive drum 2 and the charging roller 10*a* (600 V). This causes electrical discharge between the photosensitive drum 2 and the charging roller 10*a* and causes an electric current to flow in the ion conductive material in the charging roller 10*a* in an opposite direction to that in the image forming period (described later). This allows the ion conductive material, which has become polarized, to move toward an original direction. In other words, the polarization of the ion conductive material can be alleviated.

It should be noted that an upper limit of the second bias is a value smaller than a withstand voltage of the photosensitive drum 2.

In the non-image forming period, the neutralization unit 12 does not neutralize the photosensitive drum 2. In other words, the neutralization unit 12 does not irradiate the surface of the photosensitive drum 2 with light.

In addition, the control unit 103 controls the first bias application unit 101 to apply the first bias to the charging roller 10*a* in the image forming period. As a specific example, in the image forming period, the first bias application unit 101 applies +1100 V as the first bias to the charging roller 10*a*. This charges the surface of the photosensitive drum 2 to +500 V.

In addition, the control unit 103 controls the second bias application unit 102 to apply a third bias, which is of a reversed polarity to the second bias, to the transfer roller 8 in the image forming period. The third bias is a bias for transferring the toner image, which has been formed on the surface of the photosensitive drum 2, onto the paper T. As a specific example, the third bias is approximately −1000 to −1200V. Here, the image forming period is a period in which a toner image is formed on the photosensitive drum 2 by the charging unit 10, the developing unit 16 and the like and the toner image is then transferred onto the paper T by the transfer roller 8 based on a job as an instruction for forming an image on the paper T.

In a case in which image formation is consecutively performed on a plurality of sheets of paper, between the sheets of paper, the second bias application unit 102 applies a bias of a reversed polarity to the third bias (as a specific example, +500 V) to the transfer roller 8 in order to return the toner adhering to the transfer roller 8 to the photosensitive drum 2.

Figure 5:
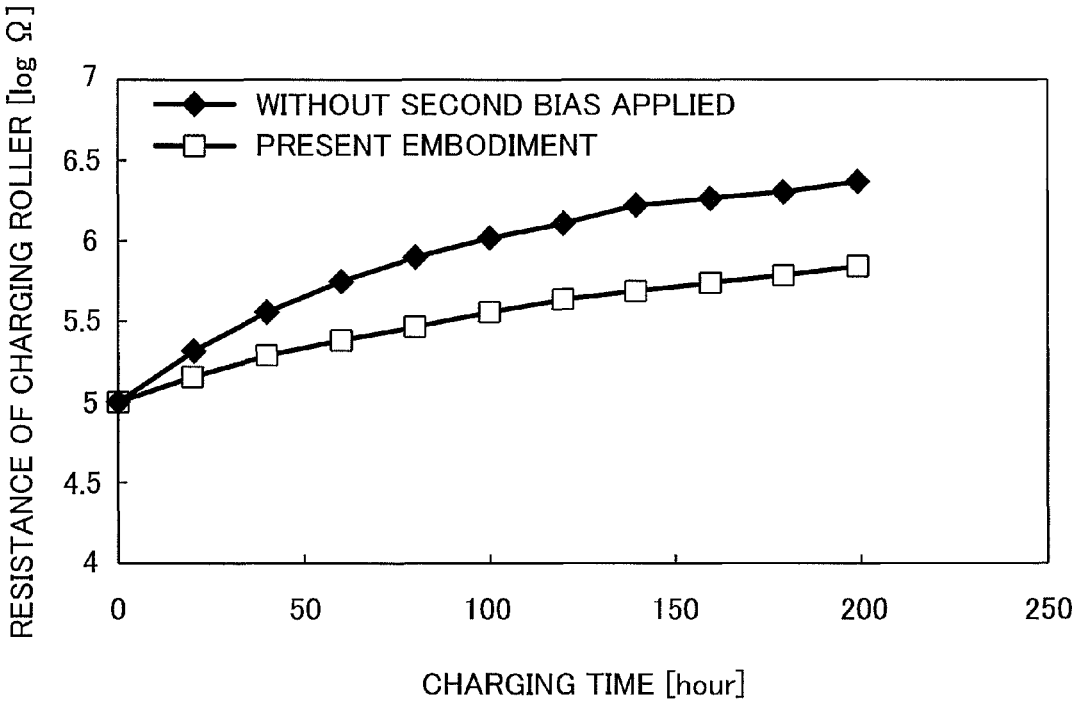
FIG. 5 is a diagram showing a relationship between resistance and charging time of the charging roller in a case of the present embodiment and in a case without performing the control of the present embodiment.

FIG. 5 is a diagram showing a relationship between resistance and charging time of the charging roller 10*a* in a case of the present embodiment and in a case without employing the present embodiment. As obvious from FIG. 5, at any charging time, the present embodiment provides a smaller resistance value than in a case without performing the control of the present embodiment (in a case of not applying the second bias to the transfer roller 8 in the non-image forming period). FIG. 5 shows that the present embodiment alleviates polarization of the ion conductive material included in the charging roller 10*a*.

Next, general operation of the printer 1 is briefly described with reference to FIG. 1.

First, single-side printing on the paper T housed in the paper feeding cassette 52 is described.

The paper T stored in the paper feeding cassette 52 is fed to the first paper path L1 by way of the forward feed roller 61 and the pair of feed rollers 63, and is subsequently conveyed through the first junction P1 and the first paper path L1 to the pair of registration rollers 80.

The pair of registration rollers 80 performs skew compensation of the paper T and timing adjustment with respect to the toner image.

The paper T discharged from the pair of registration rollers 80 is introduced between the photosensitive drum 2 and the transfer roller 8 (i.e. in the transfer nip N) through the first paper path L1. Then, a toner image is transferred onto the paper T between the photosensitive drum 2 and the transfer roller 8.

Subsequently, the paper T is discharged from between the photosensitive drum 2 and the transfer roller 8, and is introduced to a fusing nip between the heating rotor 9*a* and the pressing rotor 9*b* in the fusing unit 9 through the second paper path L2. The toner TN is then fused in the fusing nip and the toner is fixed onto the paper T.

Subsequently, the paper T is conveyed through the third paper path L3 to the paper discharging unit 50 by way of the first pair of rollers 54*a*, and is discharged from the paper discharging unit 50 to the discharged paper collection part M1 by way of the third pair of rollers 53.

Single-side printing on the paper T housed in the paper feeding cassette is thus completed.

In a case of single-side printing on the paper T placed on the manual feeding tray 65, the paper T placed on the manual feeding tray 65 is dispatched to the manual feeding path La by the paper feeding roller 66, and then conveyed to the pair of registration rollers 80 via the first junction P1 and the first paper path L1. Operations thereafter are the same as in the case of single-side printing on the paper T housed in the paper feeding cassette 52 described above, and therefore descriptions thereof are omitted.

Next, operation of the printer 1 performing duplex printing is described.

In a case of single-side printing, as described above, printing is completed by discharging the paper T printed on one side from the paper discharging unit 50 to the discharged paper collection part M1.

On the other hand, in a case of duplex printing, the paper T printed on one side is reversed compared to the single-side printing and reconveyed to the pair of registration rollers 80 via the reverse paper path Lb to thereby perform printing on both faces of the paper T.

More specifically, the operations are similar to the operations of single-sided printing as described above, until the paper T with single-sided printing performed thereon is discharged from the paper discharging unit 50 by way of the third pair of rollers 53. However, in a case of duplex printing, the third pair of rollers 53 stops the rotation, and is rotated in an opposite direction, in a state in which the paper T with single-sided printing performed thereon is held by the third pair of rollers 53. In this way, by rotating the third pair of rollers 53 in the opposite direction, the paper T held by the third pair of rollers 53 is conveyed to the opposite direction through the third paper path L3 (direction from the paper discharging unit 50 to the first branch portion Q1).

As described above, when the paper T is conveyed through the third paper path L3 in the opposite direction, the paper T is introduced between the second pair of rollers 54*b* (instead of the first pair of rollers 54*a*). The paper T then joins the first paper path L1 through the reverse paper path Lb and the second junction P2. Here, the paper T is reversed from the orientation thereof in printing on the one side.

Furthermore, the correction or adjustment is performed on the paper T by way of the pair of registration rollers 80, and the paper T is introduced between the photosensitive drum 2 and the transfer roller 8 via the first paper path L1. As an unprinted surface of the paper T is directed at the photosensitive drum 2 as a result of passing through the reverse paper path Lb, a toner image is transferred to the unprinted surface and duplex printing is thus realized.

Figure 6:
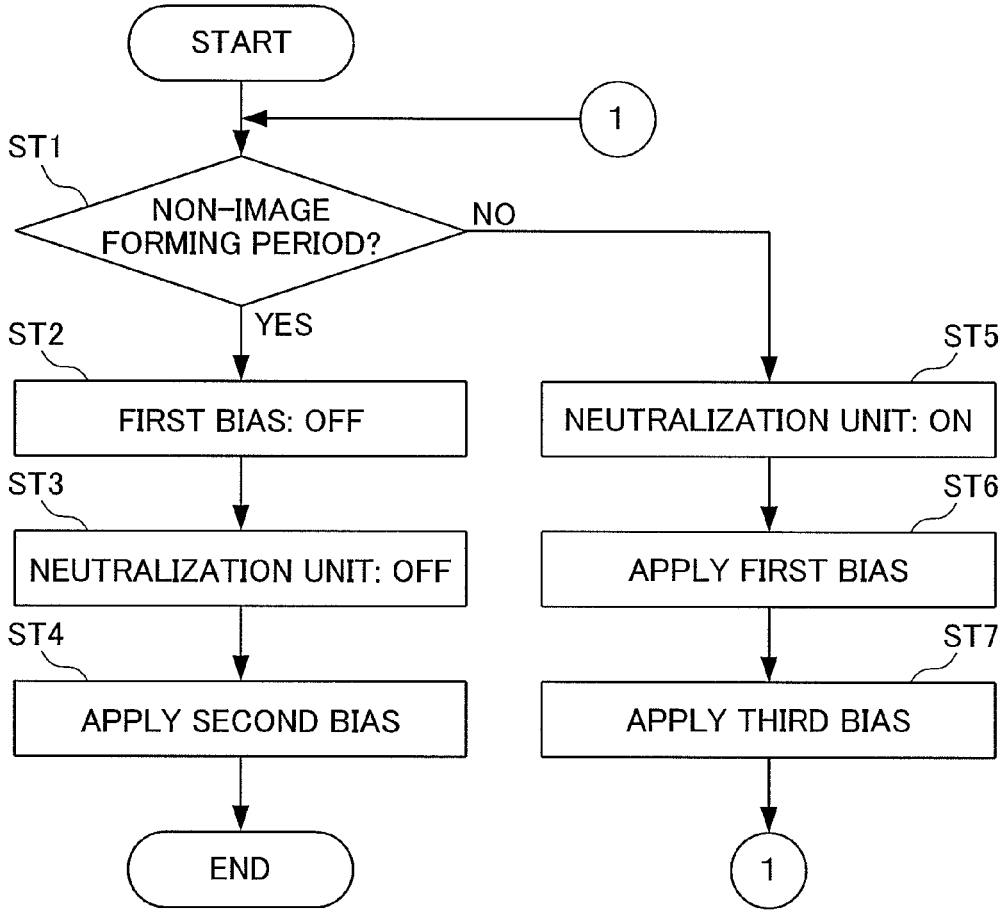
FIG. 6 is a flow chart describing characteristic operations of the printer.

Next, characteristic operations of the printer 1 are described with reference to FIG. 6. FIG. 6 is a flow chart describing characteristic operations of the printer 1.

In Step ST1, the control unit 103 determines whether the printer 1 is in the non-image forming period or not. If the printer 1 is in the non-image forming period (YES), the control unit 103 advances the processing to Step ST2. If the printer 1 is not in the non-image forming period (NO), the control unit 103 advances the processing to Step ST5.

If a YES determination is made in Step ST1, the control unit 103 performs an operation for alleviating polarization of the ion conductive material included in the charging roller 10*a*. More specifically, the following processing takes place.

In Step ST2, the control unit 103 turns off the first bias. In other words, the control unit 103 controls the first bias application unit 101 such that the first bias is not applied to the charging roller 10*a* by the first bias application unit 101.

In Step ST3, the control unit 103 turns off the neutralization unit 12. In other words, the control unit 103 controls the neutralization unit 12 not to irradiate the photosensitive drum 2 with light from the neutralization unit 12.

In Step ST4, the control unit 103 controls the second bias application unit 102 such that the second bias is applied to the transfer roller 8 by the second bias application unit 102. After the Step ST4, the processing terminates.

On the other hand, if a NO determination is made in Step ST1, the control unit 103 forms an image on the paper T. More specifically, the general operation of the printer 1 described above takes place. In summary, the following processing takes place.

In Step ST5, the control unit 103 turns on the neutralization unit 12. In other words, the control unit 103 controls the neutralization unit 12 to irradiate the photosensitive drum 2 with light from the neutralization unit 12.

In Step ST6, the control unit 103 controls the first bias application unit 101 to apply the first bias to the charging roller 10*a* by the first bias application unit 101.

In Step ST7, the control unit 103 controls the second bias application unit 102 to apply the third bias to the transfer roller 8 by the second bias application unit 102. After the processing of Step ST7, the control unit 103 makes the determination of Step ST1. In a case in which a job has been completed, the control unit 103 makes an YES determination, again in Step ST1.

As described above, the printer 1 of the present embodiment provides the following effects.

The printer 1 of the present embodiment includes: the control unit 103 that controls the first bias application unit 101 and the second bias application unit 102. The control unit 103 controls the first bias application unit 101 not to apply the first bias to the charging roller 10*a* in the non-image forming period. In addition, the control unit 103 controls the second bias application unit 102 to apply the second bias, which is a bias that can electrically charge the surface of the photosensitive drum 2, to the transfer roller 8 in the non-image forming period. Here, in a case in which the surface of the photosensitive drum 2 is electrically charged by the transfer roller 8 to which the second bias has been applied, a potential difference between the photosensitive drum 2 and the charging roller 10*a* is greater than a voltage at which electrical discharge starts between the photosensitive drum 2 and the charging roller 10*a*. The printer 1 can thus alleviate polarization of the ion conductive material included in the charging roller 10*a*.

In addition, the control unit 103 controls the first bias application unit 101 to apply the first bias to the charging roller 10*a* in the image forming period. In addition, the control unit 103 controls the second bias application unit 102 to apply the third bias, which is of a reverse polarity to the second bias, to the transfer roller 8 in the image forming period. The printer 1 uses the second bias application unit 102 also in the image forming period. In other words, the printer 1 uses the second bias application unit 102, which is already provided, to apply the second bias to the transfer roller 8 in the non-image forming period. As a result, since no additional configuration or component is required for applying the second bias to the transfer roller 8, the printer 1 can prevent increase the space from becoming small and can suppress increases in cost.

Although preferred embodiments have been described above, the present disclosure is not limited to the aforementioned embodiments, and can be carried out in various modes.

For example, a monochrome printer 1 is exemplified in the present embodiment as the image forming apparatus; however, the present disclosure is not limited thereto and the image forming apparatus can be a color printer, a copy machine, a facsimile machine, and a multi-functional peripheral having functions thereof.

The invention claimed is:

1. An image forming apparatus comprising: an image carrier;

a charging member having an ion conductive material, the charging member being arranged in contact with or in proximity to the image carrier and charging a surface of the image carrier;

a developing unit that forms a toner image on the surface of the image carrier;

a transfer member that transfers the toner image formed on the surface of the image carrier to a transfer object;

a first bias application unit that applies a first bias to the charging member;

a second bias application unit that applies a predetermined bias to the transfer member; and a control unit that controls the first bias application unit and the second bias application unit, wherein, in a non-image forming period in which the toner image is not formed on the image carrier, the control unit controls the first bias application unit not to apply the first bias to the charging member and controls the second bias application unit to apply a second bias, which is a bias that can electrically charge the surface of the image carrier, to the transfer member.

2. The image forming apparatus according to claim 1, wherein, in a case in which the surface of the image carrier is electrically charged by the transfer member to which the second bias has been applied, a potential difference between the image carrier and the charging member is greater than a voltage at which electrical discharge starts between the image carrier and the charging member.

3. The image forming apparatus according to claim 1, wherein, in an image forming period in which the toner image is formed on the image carrier and the toner image is transferred to the transfer object, the control unit controls the first bias application unit to apply the first bias to the charging member and controls the second bias application unit to apply a third bias of reverse polarity to the second bias to the transfer member.

* * * * *